US010343754B1

(12) United States Patent
Maresh

(10) Patent No.: US 10,343,754 B1
(45) **Date of Patent: *Jul. 9, 2019**

(54) OSCILLATING FIN PROPULSION APPARATUS

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,100

(22) Filed: Jun. 8, 2017

Related U.S. Application Data

(63) Continuation of application No. 14/930,997, filed on Nov. 3, 2015, now Pat. No. 9,676,459.

(60) Provisional application No. 62/123,446, filed on Nov. 17, 2014, provisional application No. 62/123,805, filed on Nov. 29, 2014, provisional application No. 62/125,283, filed on Jan. 16, 2015, provisional application No. 62/125,874, filed on Feb. 2, 2015, provisional application No. 62/177,008, filed on Mar. 3, 2015, provisional application No. 62/177,786, filed on Mar. 23, 2015, provisional application No. 62/178,201, filed on Apr. 2, 2015.

(51) Int. Cl.
*B63H 1/30* (2006.01)
*B63H 5/00* (2006.01)
*B63H 1/32* (2006.01)

(52) U.S. Cl.
CPC ..... *B63H 5/00* (2013.01); *B63H 1/32* (2013.01)

(58) Field of Classification Search
CPC ..... B63H 1/32; B63H 5/00; B63H 2005/00
USPC ..... 440/13–15
See application file for complete search history.

(56) References Cited

U.S. PATENT DOCUMENTS 2,213,538 A * 9/1940 Whitehead ..... B63H 16/04 416/74
3,038,435 A * 6/1962 Fairfax ..... B63H 16/00 440/13
4,102,293 A * 7/1978 de la Roche Kerandraon ..... B63H 11/06 440/13
4,490,119 A * 12/1984 Young ..... B63H 1/36 416/83
5,401,196 A * 3/1995 Triantafyllou ..... B63H 1/36 440/13
6,877,692 B2 * 4/2005 Liu ..... B63H 1/36 244/22
6,974,356 B2 * 12/2005 Hobson ..... B60F 3/0007 244/22

(Continued)

*Primary Examiner* — Daniel V Venne
(74) *Attorney, Agent, or Firm* — Nick A Nichols, Jr.

(57) ABSTRACT

A water propulsion apparatus operatively connected to a body moving on or through a body of water, may produce a propulsive force by sweeping fins in an oscillating motion in a generally transverse direction relative to a longitudinal axis of the body. The fins may be mounted on opposite sides of a frame and are rotatable about a first axis coplanar to the center longitudinal axis of the frame. Drive members rotatable about a second axis that is canted relative to the first axis may be operatively connected to the fins. The oscillatory motion of the fins may be controlled by torque applied at the canted second axis by reciprocating the drive members in a generally vertical plane parallel to the center longitudinal axis of the frame. The oscillating fins may provide a propulsive force during both oscillating directions of the fins as they sweep back and forth.

9 Claims, 16 Drawing Sheets

(56) References Cited

U.S. PATENT DOCUMENTS

| | | | | |
|---|---|---|---|---|
| 7,637,791 | B2 * | 12/2009 | Ketterman | B63H 1/36 440/13 |
| 7,744,434 | B2 * | 6/2010 | Wu | B63H 1/32 440/14 |
| 2009/0191772 | A1 * | 7/2009 | Wu | B63H 1/32 440/14 |
| 2009/0311926 | A1 * | 12/2009 | Ketterman | B63H 1/36 440/13 |
| 2010/0285703 | A1 * | 11/2010 | Vermeiden | B63H 1/32 440/14 |
| 2010/0291814 | A1 * | 11/2010 | Vermeiden | B63H 1/36 440/13 |
| 2014/0134901 | A1 * | 5/2014 | Ketterman | B63H 16/12 440/14 |

* cited by examiner

Fig. 2
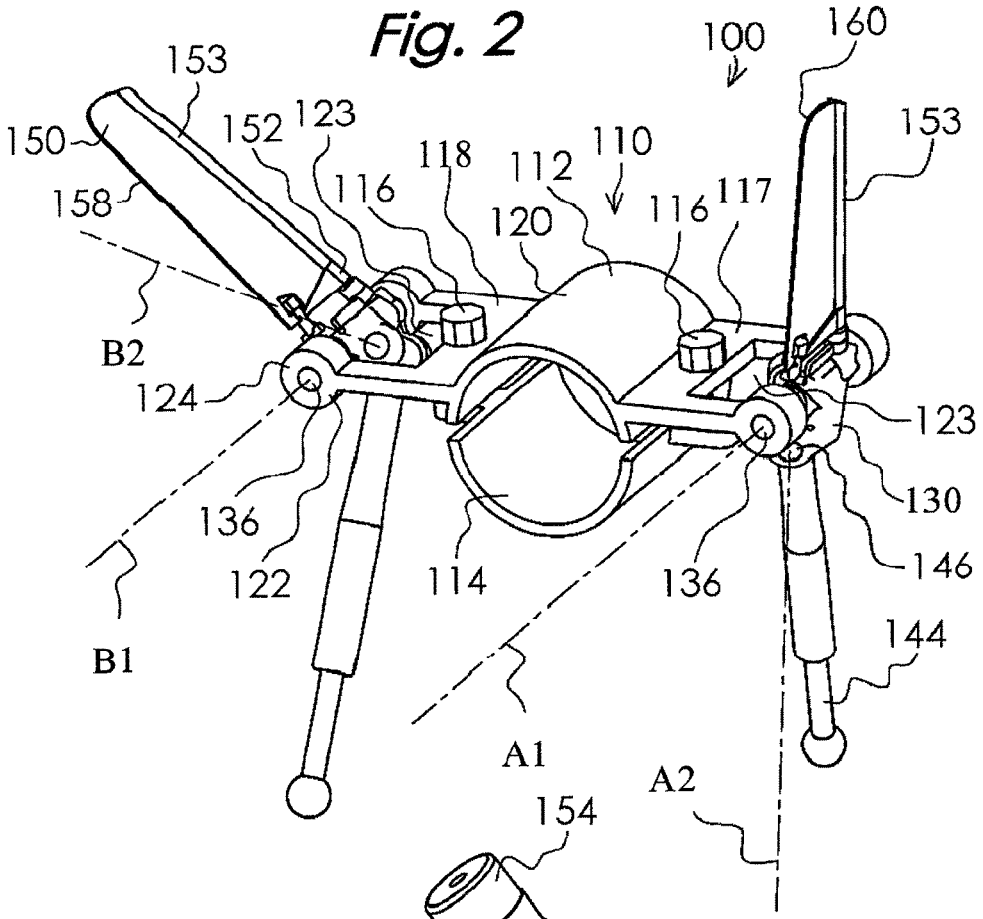
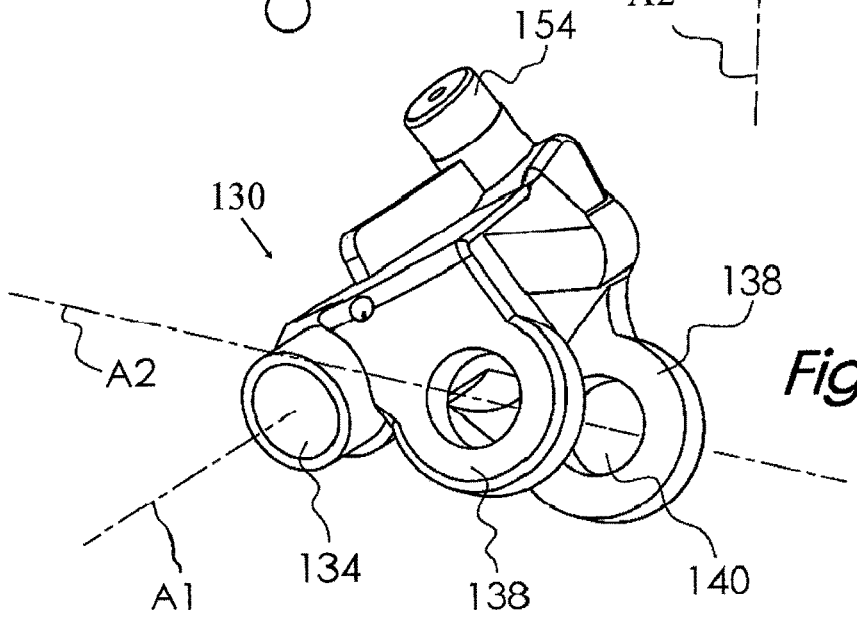
Fig. 4

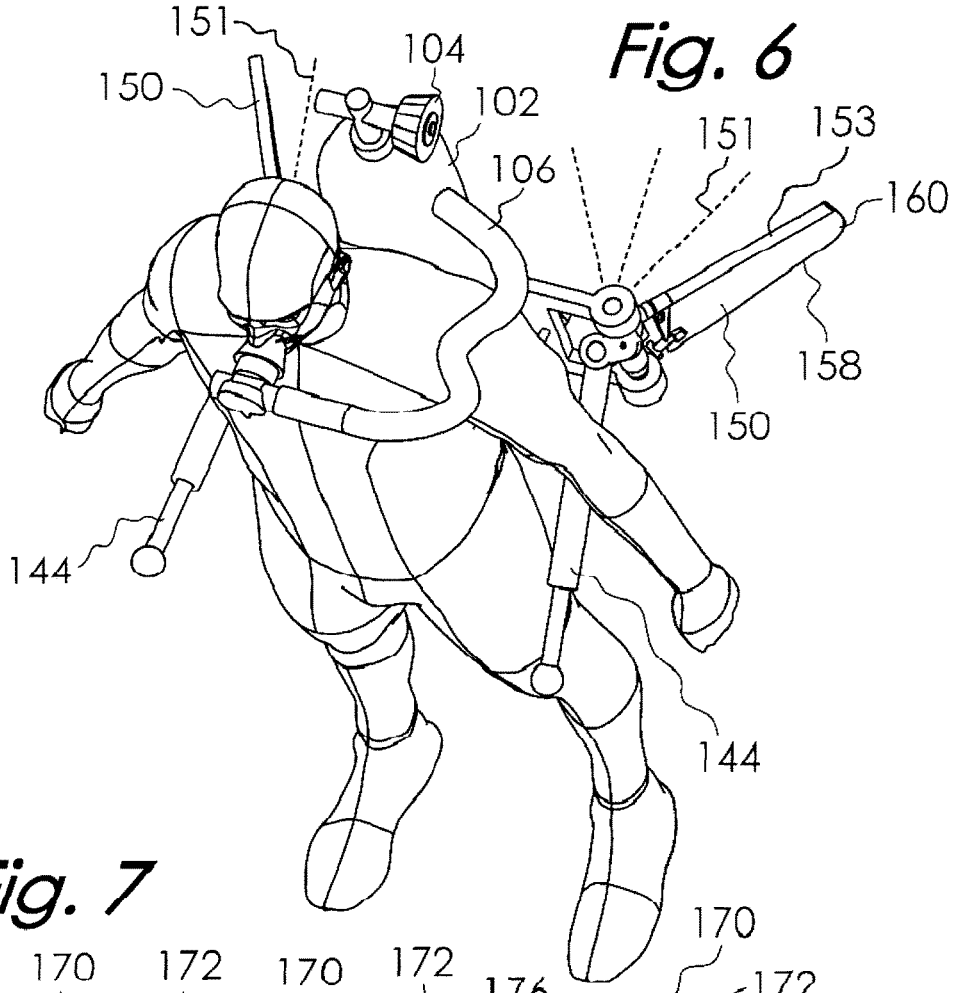
Fig. 6
Fig. 7
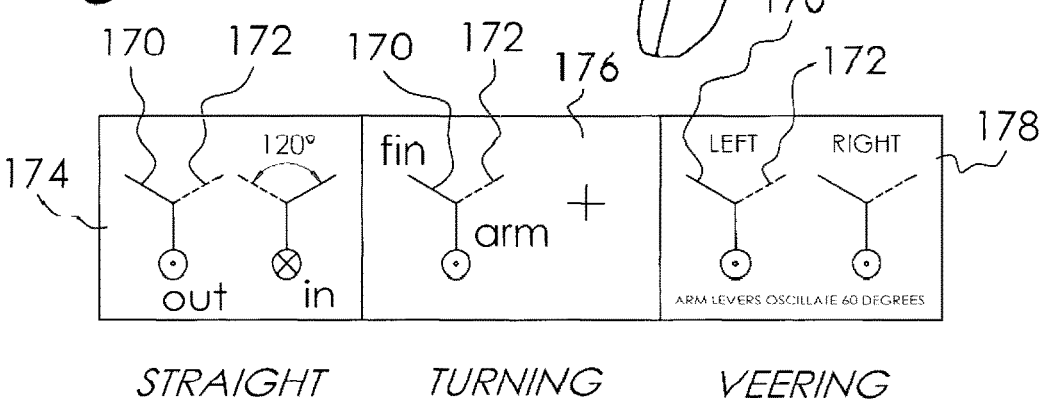

OSCILLATING FIN PROPULSION APPARATUS

CROSS-REFERENCE TO RELATED APPLICATION

This application is a continuation of U.S. Non-Provisional application Ser. No. 14/930,997, filed Nov. 3, 2015, now U.S. Pat. No. 9,676,459, which claims the benefit of U.S. Provisional Application Ser. No. 62/123,446, filed Nov. 17, 2014, U.S. Provisional Application Ser. No. 62/123,805, filed Nov. 29, 2014, U.S. Provisional Application Ser. No. 62/125,283, filed Jan. 16, 2015, U.S. Provisional Application Ser. No. 62/125,874, filed Feb. 2, 2015, U.S. Provisional Application Ser. No. 62/177,008, filed Mar. 3, 2015, U.S. Provisional Application Ser. No. 62/177,786, filed Mar. 23, 2015, and U.S. Provisional Application Ser. No. 62/178,201, filed Apr. 2, 2015, which applications are incorporated herein by reference in their entirety.

BACKGROUND

The present invention relates to a water propulsion apparatus, and more generally, to a thrust generating oscillating fin propulsion apparatus adapted for underwater propulsion.

Pedal operated propulsion apparatus, such as a foot operated paddle boat described in U.S. Pat. No. 3,095,850, are known in the art. Other pedal operated means linking rotatable pedals to a propeller have been proposed. Some have looked to the swimming motion of sea creatures to design mechanically powered propulsion systems. Generally speaking, the swimming behavior of sea creatures may be classified into two distinct modes of motion: middle fin motion or median and paired fin (MPF) mode and tail fin or body and-caudal fin (BCF) mode, based upon the body structures involved in thrust production. Within each of these classifications, there are numerous swimming modes along a spectrum of behaviors from purely undulatory to entirely oscillatory modes. In undulatory swimming modes thrust is produced by wave-like movements of the propulsive structure (usually a fin or the whole body). Oscillatory modes, on the other hand, are characterized by thrust production from a swiveling of the propulsive structure at the attachment point without any wave-like motion. A penguin or a turtle, for example, may be considered to have movements generally consistent with an oscillatory mode of propulsion.

In 1997, Massachusetts Institute of Technology (MIT) researchers reported that a propulsion system that utilized two oscillating blades of MPF mode produced thrust by sweeping back and forth in opposite directions had achieved efficiencies of 87%, compared to 70% efficiencies for conventional watercraft. A 12-foot scale model of the MIT Proteus "penguin boat" was capable of moving as fast as conventional propeller driven watercraft. Another MIT propulsion system referred to as a "Robotuna," utilized a tail in BCF mode propulsion patterned after a blue fin tuna, achieved efficiencies of 85%. Based upon limited studies, higher efficiencies of 87% (and by some reports 90-95% efficiency) may be possible with oscillatory MPF mode propulsion that may enable relatively long distances of human powered propulsion being achieved both on and under the water surface.

U.S. Pat. No. 6,022,249 describes a kayak having a propulsion system that extends below the water line. The propulsion system includes a pair of flappers in series, each adapted to oscillate through an arcuate path in a generally transverse direction with respect to the central longitudinal dimension of the kayak.

SUMMARY

In an oscillating fin propulsion apparatus operatively connected to a body moving on or through a body of water, propulsive force may be produced by a pair of fins adapted to sweep back and forth in a generally transverse direction relative to the longitudinal axis of the body. The fins may be mounted on opposite sides of a frame and are rotatable about a first axis coplanar to the center longitudinal axis of the frame. Drive members rotatable about a second axis that is canted relative to the first axis may be operatively connected to the fins. The oscillatory motion of the fins may be controlled by torque applied at the canted second axis by reciprocating the drive members in a plane generally parallel to the center longitudinal axis of the frame. The oscillating fins may provide a propulsive force to propel the body longitudinally forward during both oscillating directions of the fins as they sweep back and forth.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 2 is a perspective view of an oscillating fin propulsion apparatus.

FIG. 4 is a perspective view of a mounting block of the oscillating fin propulsion apparatus shown in FIG. 2.

FIG. 6 is a perspective view of diver outfitted with the oscillating fin propulsion apparatus shown in FIG. 5.

FIG. 7 is a diagram illustrating swimming maneuvers that a diver may perform outfitted with the oscillating fin propulsion apparatus shown in FIG. 5.

DETAILED DESCRIPTION

Figure 1:
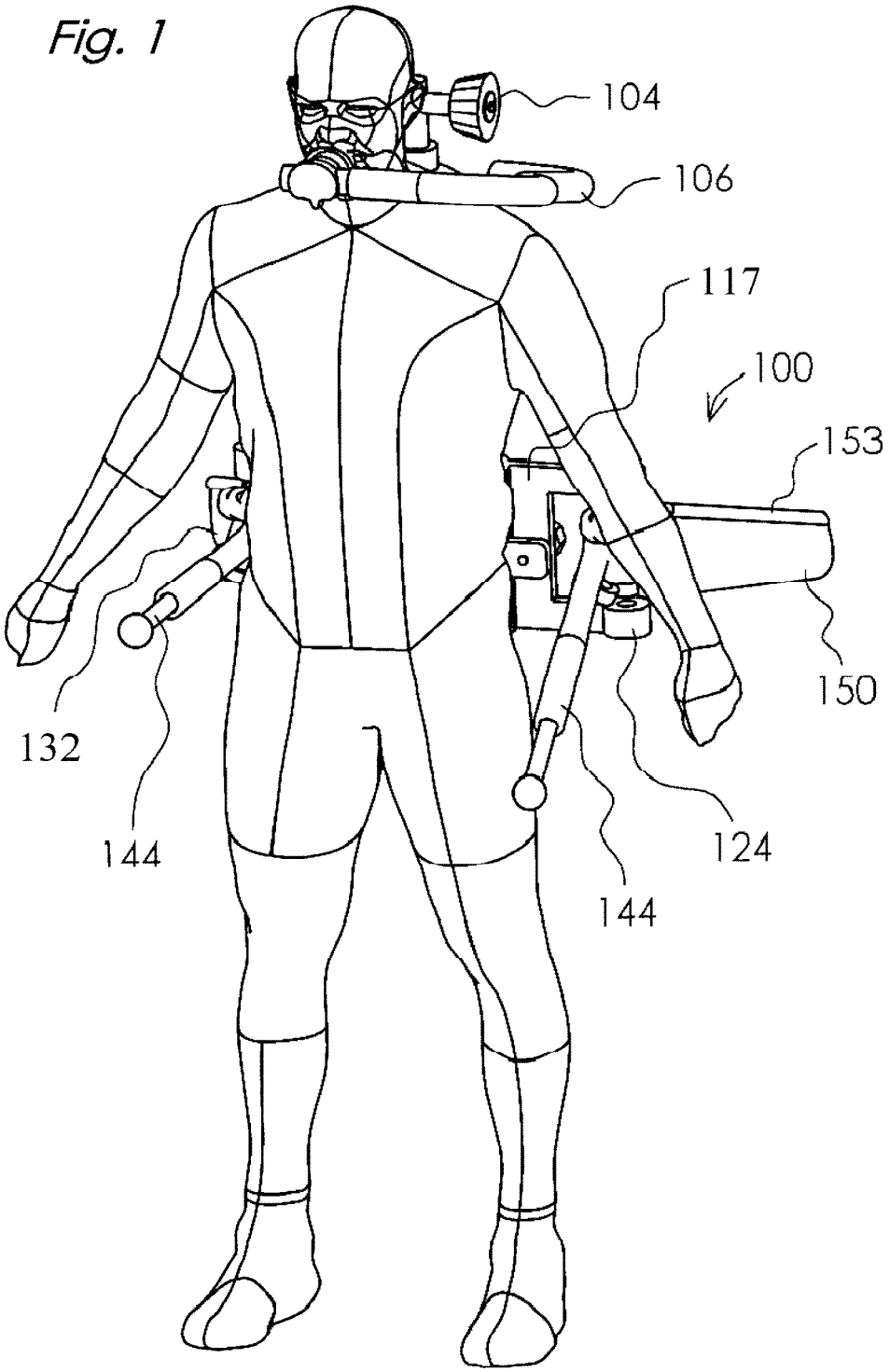
FIG. 1 is a perspective view of a diver outfitted with an oscillating fin propulsion apparatus.

Referring first to FIG. 1, a scuba diver is illustrated outfitted with an oscillating fin propulsion apparatus. The propulsion apparatus is generally identified by the reference numeral 100. An air tank 102 (not shown in FIG. 1), including valves and associated regulator 104 and hose 106, may be secured to the diver by means known in the art.

The propulsion apparatus 100, shown in greater detail in FIG. 2, may include a frame 110 split into two separable parts, including an upper frame member 112 and a lower frame member 114. The frame members 112, 114 may be configured to clamp about the diver's air tank 102, shown in FIG. 5. Knobs 116 threadably connecting the frame members 112, 114 may be provided to concentrically secure the frame 110 about the air tank 102. The knobs 116 may thereafter be untightened to remove the propulsion apparatus 100 from the air tank 102. Alternatively, other means, such as straps tightened with cam clamps and the like, may be used to secure the propulsion apparatus 100 to the air tank 102.

Figure 3:
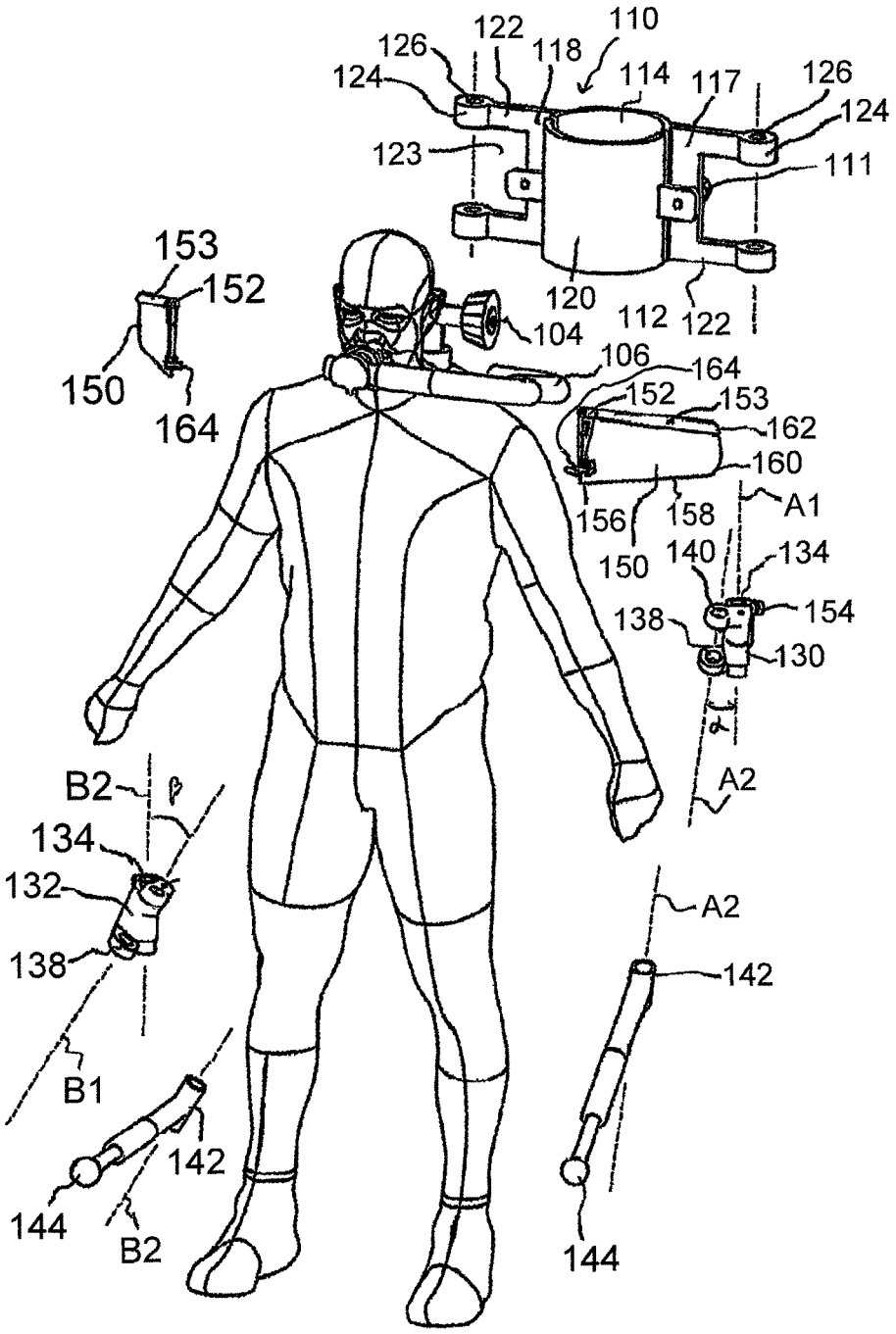
FIG. 3 is an exploded perspective view of the oscillating fin propulsion apparatus shown in FIG. 2.
Figure 5:
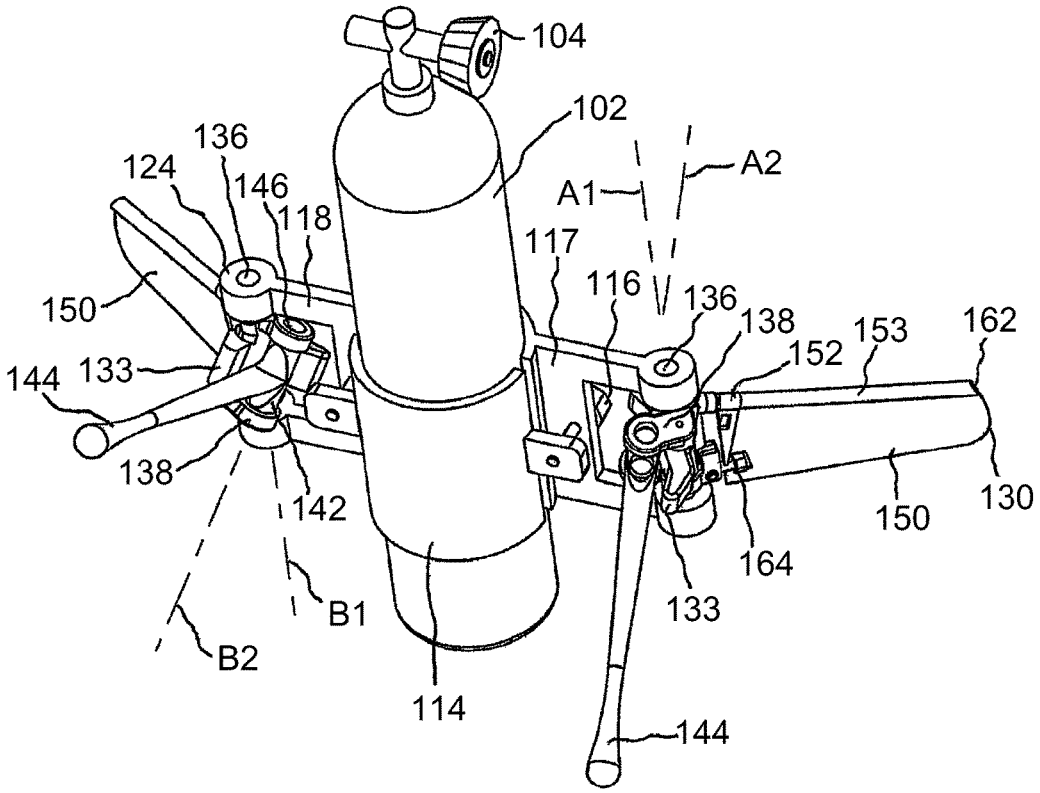
FIG. 5 is a perspective view of the oscillating fin propulsion apparatus shown in FIG. 2 mounted on a scuba air tank.

Referring now to FIGS. 3 and 5, the frame member 112 may include a substantially semi-cylindrical intermediate portion 120, and left and right lateral portions 117 and 118 extending outwardly from opposite lateral sides of the intermediate portion 120. For convenience and clarity, the terms "left" and "right" as used herein mean the diver's left and right sides. The left and right lateral portions 117, 118 may define a horizontal transverse plane perpendicular to a vertical plane extending through the center longitudinal axis of the frame 110. The distal ends of the lateral portions 117, 118 may terminate in arms 122 that are spaced apart from one another and define a gap 123 therebetween. Lobes 124 may form the distal ends of the arms 122. The spaced apart lobes 124 may include holes 126 extending therethrough, which are axially aligned relative to one another.

Left and right canted journal blocks 130 and 132, respectively, may be rotatably secured to the frame 110. The canted journal blocks 130, 132 may include an axial borehole 134 for receiving a shaft 136 therethrough, shown in FIG. 2. The canted journal blocks 130, 132 may be rotatably secured to the frame 110 by positioning the canted journal blocks 130, 132 in respective gaps 123 and aligning the borehole 134 of each canted journal block 130, 132 with the aligned holes 126 in the lobes 124. The shaft 136 may thereafter be inserted through the borehole 134 and the holes 126 of the arms 122, thereby rotatably securing the canted journal blocks 130, 132 to the frame 110, as best shown in FIG. 2. The canted journal blocks 130, 132 may include first axes A1 and B1, respectively, coincident with the center longitudinal axis of the boreholes 134. The axes A1 and B1 may extend parallel to the longitudinal center axis of the frame 110.

Referring next to FIGS. 3 and 4, each canted journal block 130, 132 may include a pair of spaced apart upstanding tabs 138. The tabs 138 include through holes 140 that are axially aligned with one another. Lower distal ends 142 of elongated drive handles 144 may be rotatably secured between the tabs 138 of each canted journal block 130, 132 by a shaft 146, shown in FIG. 2. The distal end 142 of the drive handles 144 may comprise a hollow tube fixed to or integrally formed with the drive handles 144 extending transversely to the longitudinal axis of the drive handles 144. Each drive handle 144 may include a grip portion proximate the upper distal end thereof that may be grasped by the diver to reciprocate the drive handles 144 in a generally vertical plane perpendicular to the horizontal transverse plane defined by the lateral portions 117, 118 of the frame 110. The phrase "generally vertical" as used herein means substantially vertical but may include a horizontal component, it being understood that the reciprocating arm movements of individual divers may vary somewhat from true vertical. Guide members may be provided at the distal ends of the lateral portions 117, 118 of the frame 110 to generally constrain the drive handles 144 to reciprocate in a generally vertical plane. The guide members may be integrally formed with the frame 110 or alternatively removably attached to the frame 110 to train divers to properly reciprocate the drive handles 114 through a full stroke without wasted motions. Thereafter, the guide members may be removed.

The left canted journal block 130, shown in FIG. 4, may include a second axis A2 defining the longitudinal axis passing through the center of the through holes 140 of the tabs 138. The second axis A2 may be displaced and canted relative to the first axis A1 of the canted journal block 130. The first axis A1 and the second axis A2 of the left canted journal block 130 may be angularly displaced from one another by an angle $\alpha$ of about ten(10°) to forty-five(45°) degrees. Preferably, the angle $\alpha$ may be about thirty (30°) degrees. An angular displacement between the first and second axis A1, A2 greater than thirty (30°) degrees may require greater extension of the diver's arms to reciprocate the drive handles 144 for a given range of oscillation of the fins 150 of the propulsion apparatus 100. Likewise, for an angular displacement less than thirty degrees (30°), less extension of the diver's arms may be required for a given range of oscillation of the fins 150. The canted journal blocks 130, 132 may include stops 133, shown in FIG. 5, to prevent over centering of the drive handles 144 as they rotate about the shafts 146.

As will be understood by use of the same reference numerals, the right canted journal block 132, shown in FIG. 3, is configured substantially the same as the left canted journal block 130. The right canted journal block 132 may include a second axis B2 defining the longitudinal axis passing through the center of the through holes 140 of the tabs 138 projecting from the right canted journal block 132. The second axis B2 may be displaced and canted relative to the first axis B1 of the right canted journal block 132. The first axis B1 and second axis B2 of the canted journal block 132 may be angularly displaced from one another by an angle $\beta$ of about ten (10°) to forty-five (45°) degrees, preferably about thirty (30°) degrees, as described in greater detail hereinabove with reference to the angular displacement of axes A1 and A2.

It should be noted that the canted axis blocks 130, 132 may be molded identically (as illustrated throughout the drawings) where oscillation of the fins 150 ranges between ten and two o'clock positions when viewing a diver moving horizontally facing downwardly. However, for example, but not by way of limitation, where oscillation of the fins 150 may range between one and five o'clock positions, distinct and separately molded left and right canted axis blocks 130, 132 may be required, where the canted axes A2 and B2 of the canted axis blocks 130, 132 are identically oriented for the left and right sides of the propulsion apparatus, however, the bosses 154 may have a left side orientation and a right side orientation relative to the axes A1 and B1, respectively.

Referring again to FIGS. 3 and 5, a fin 150 may be connected to each of the canted journal blocks 130, 132. The fins 150 may be secured to a fin mast 152 rigidly connected to a respective canted journal block 130, 132 at a boss 154. The elongated fin mast 152 may be received in a longitudinal borehole extending the length of the fin 150 proximate the leading edge 153 thereof. The fin 150 may be fixedly secured to the fin mast 152. Alternatively, the fin 150 may be permitted to rotate relative to the fin mast 152. A transverse base 155 of the fin 150 may extend from the leading edge 153 of the fin 150 to a substantially squared off corner 156. The trailing edge 158 of the fin 150 may extend from the squared off corner 156 to the distal end 160 of the fin 150. The distal end 160 may be squared off or curved toward the distal end 162 of the fin mast 152.

The fin 150 may comprise a substantially flat body that is thicker along it leading edge 153. The thickness of the fin 150 may gradually decrease from the leading edge 153 to the trailing edge 158. The stiffness or rigidity of the fin 150 is generally greater at the leading edge 153 and decreases toward the trailing edge 158. Combination of different materials in the manufacture of the fin 150 or other manufacturing means may alter the stiffness characteristics of the fin 150. Tension in the trailing edge 158 of the fin 150 may be adjusted by tensioning means 164 to increase the stiffness of the fin 150 at the trailing edge 158 or lessen the tension so that the thinner portion of the fin 150 is more flaccid. Alternatively, each canted journal block 130, 132 may include a pair of spaced apart rigid plates securing the fins 150 thereto, described in greater detail later herein.

Referring now to FIG. 6, a diver outfitted with a scuba tank 102 is illustrated. The tank 102, including valves and associated regulator 104 and hose 106, may be secured to an unillustrated harness secured to the diver by means known in the art. Prior to securing the tank 102 to the harness, the propulsion apparatus 100, described in greater detail hereinabove, may be mounted on the tank 102 by tightening the knobs 116, thereby clamping the upper frame member 112 and lower frame member 114 about the tank 102.

During operation, the diver may grasp the drive handles 144 and moves them in a reciprocal fashion within a generally vertical plane to effectuate transverse oscillatory movement of the fins 150. The diver may accomplish various operational maneuvers with the propulsion apparatus 100. The block diagrams shown in FIG. 7, illustrate the movement of the fins 150 while the diver is maneuvering straight ahead, turning and veering. For purposes of illustration, but not by way of limitation, the diver is assumed to be facing downward in the diagrams shown in FIG. 7. The initial positions of the fins 150 and arms of the diver are shown with solid lines 170, and end positions are shown with dashed lines 172, generally representing the end points of the arcuate path of the fins 150 with each full stroke of the drive handles 144. Generally, with canted axes displacement of thirty degrees (30°) between axes A1, A2 and axes B1, B2 of the canted journal blocks 130,132, respectively, the fins 150 may each transversely oscillate about one hundred and twenty degrees (120°) before angular constraints may be experienced. One hundred and twenty degrees (120°) of fin oscillation may occur while the drive handles 144 are reciprocated in a generally vertical plane through approximately sixty degrees (60°).

During straight line forward motion of the diver, illustrated in block 174, drive handles 144 may be moved in a reciprocating and oppositional manner causing the fins 150 to move in opposition to each other while oscillating transversely. Lateral forces are canceled due to the oppositional motion of the fins 150 in the body of water thereby ensuring body roll does not occur during oscillation of the fins 150.

To execute a right turn, illustrated in block 176, the left drive handle 144 may be operated in a reciprocating manner while the right drive handle 144 is held stationary. In this instance the right side of the propulsion apparatus 100 does not create water flow resistance while the diver maintains his speed through the turn because the stationary right fin 150 is generally streamlined and has a low projected frontal area exposed to the passing stream of water. In a similar manner a left turn may be executed by reciprocating the right drive handle 144 while the left drive handle 144 is held stationary.

A veering or lateral shifting maneuver, illustrated in block 178, may be executed by reciprocating the drive handles 144 in unison in a rapid manner, followed by reciprocating the drive handles 144 in unison relatively slowly and returning the drive handles 144 and the fins 150 to the start point for continued veering action. By coordinating the phasing of drive handles 144 actuation, a diver may affect yaw and/or roll of the diver's general orientation while performing relatively complex maneuvers.

Directing attention again to FIG. 6, multiple orientations of the fins 150 of the propulsion apparatus 100 are depicted by phantom lines 151, as the drive handles 144 are reciprocated. As more fully discussed above, propulsion is generated in both oscillating directions of the fins 150. The pitch of the fins 150 is reversed upon reversal of the oscillation direction of fins 150 at the end of their transverse movement with each stroke of the drive handles 144, thereby providing a propulsive force in a longitudinal forward direction in both directions of transverse movement as the fins 150 sweep back and forth.

Figure 8:
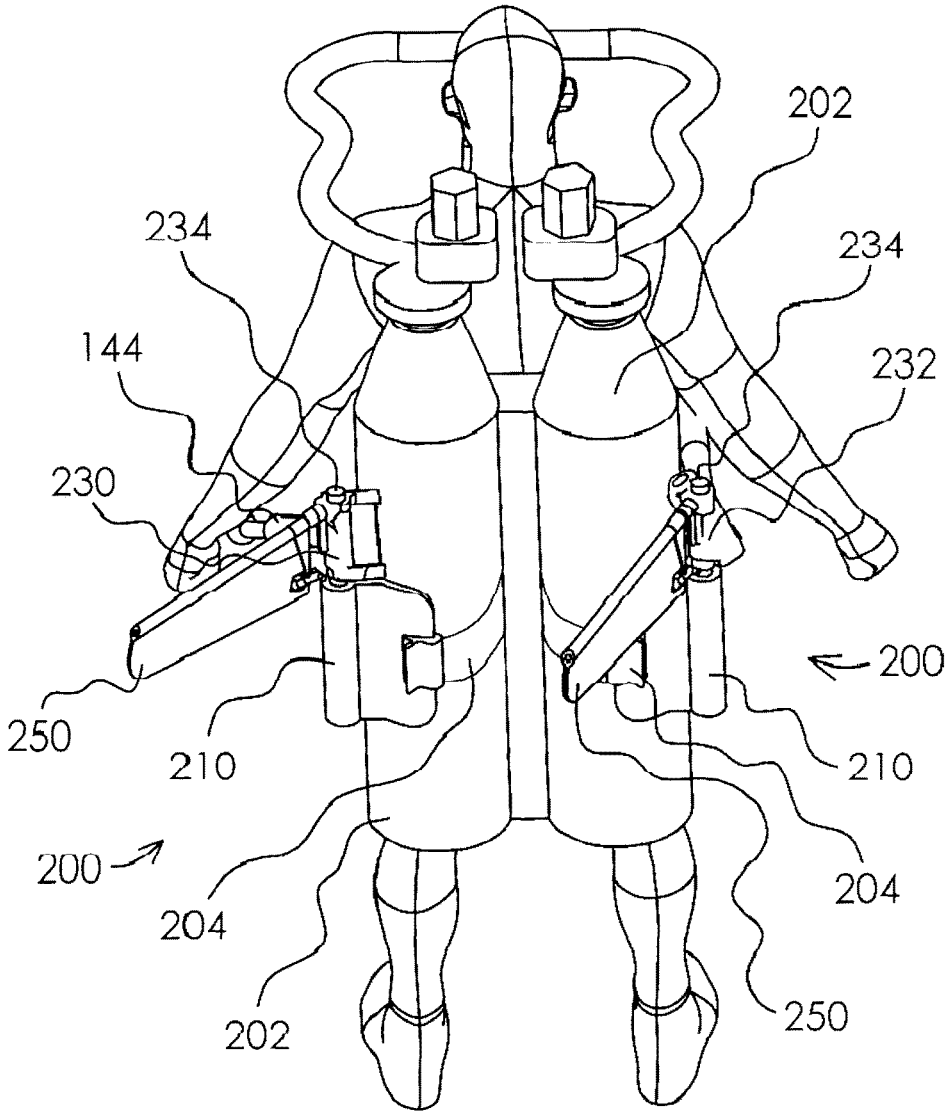
FIG. 8 is a perspective view of a diver outfitted with a second embodiment of an oscillating fin propulsion apparatus.
Figure 9:
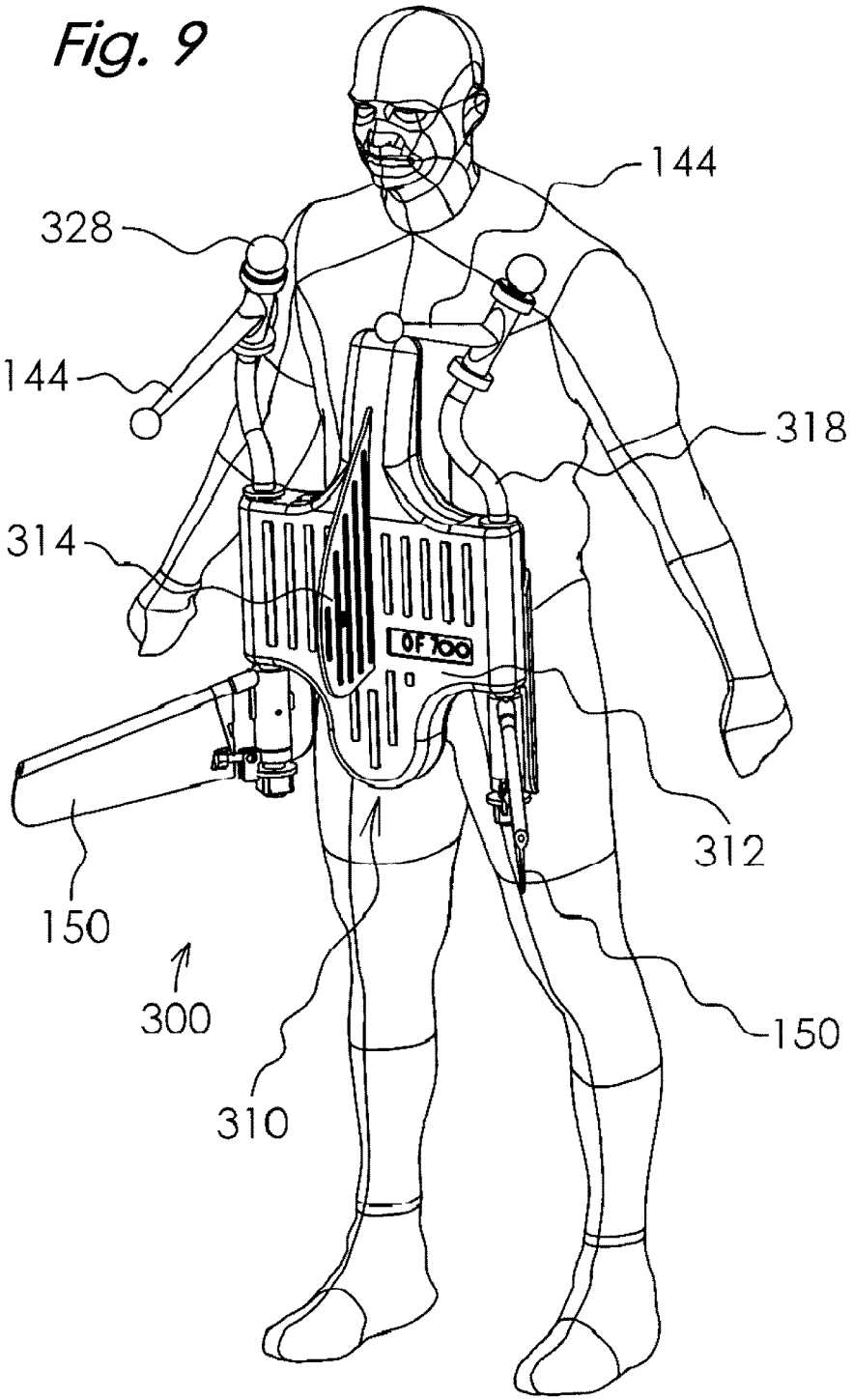
FIG. 9 is a perspective view of a diver outfitted with a third embodiment of an oscillating fin propulsion apparatus.
Figure 10:
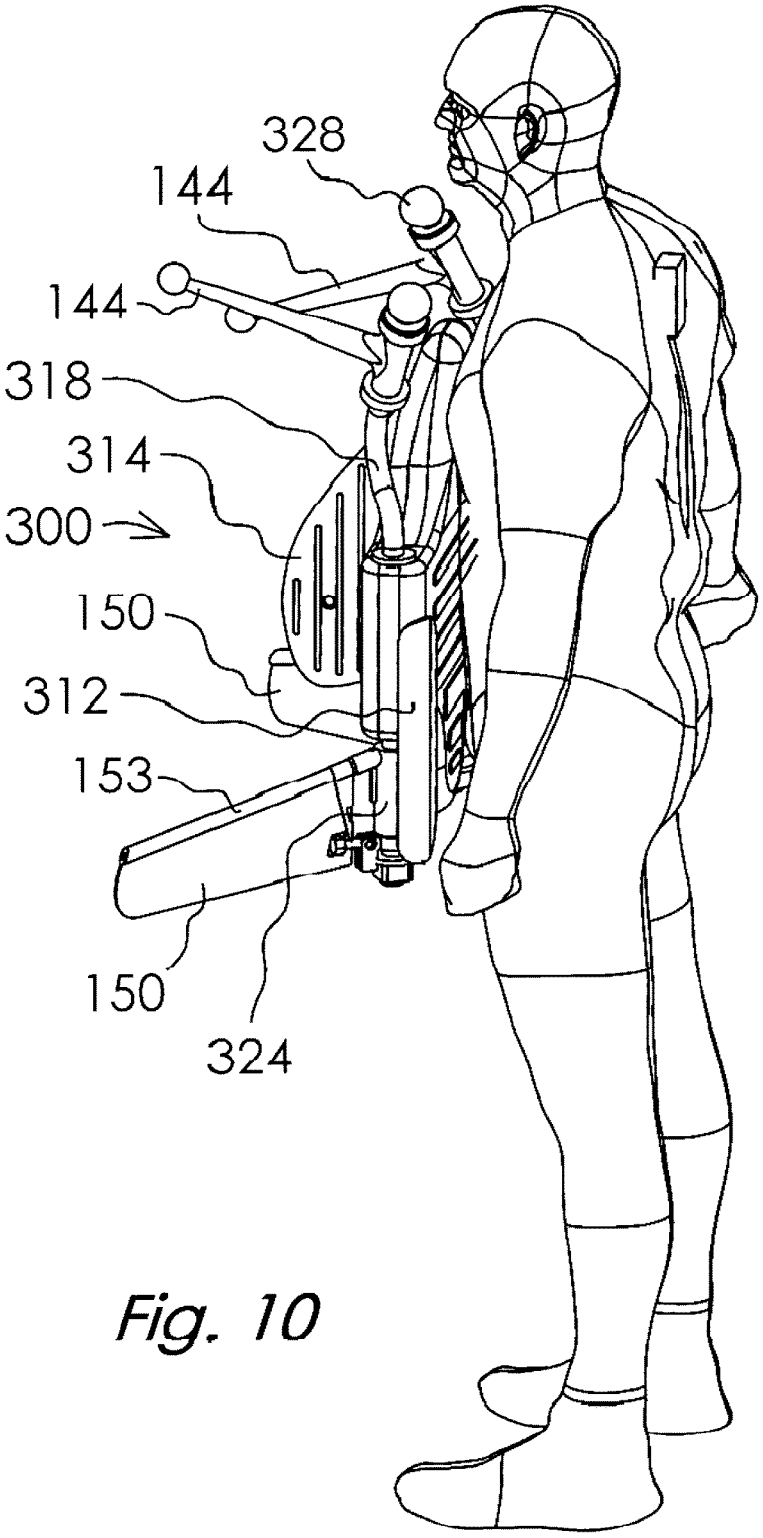
FIG. 10 is a side perspective view of the diver outfitted with the third embodiment of an oscillating fin propulsion apparatus shown in FIG. 9.

Referring now to FIG. 8, a second embodiment of a propulsion apparatus is generally identified by the reference numeral 200. As indicated by the use of common reference numerals, the propulsion apparatus 200 is similar to the propulsion apparatus 100 with the exception that a propulsion apparatus 200 is secured to each of a pair of air tanks 202 by straps 204. Each propulsion apparatus 200 may include frame members 210 configured to match the curvature of the air tanks 202 and are secured thereon by straps 204 which are tightened by an unillustrated cam locking mechanism of a type known in the art. Canted journal blocks 230 and 232 may be rotatably secured to longitudinal shafts 234 projecting from the frame members 210. Drive handles 144 are rotatably connected to the canted journal blocks 230, 232 by a shaft 146 in the manner described above with reference to propulsion apparatus 100. The orientation of fins 250 depicted in FIG. 8 indicate that the diver has completed a veering action or lateral shifting maneuver to the diver's right while simultaneously reciprocating both drive handles 144 downward generally toward the feet of the diver in a rapid manner. The diver may perform a veering action to the left by rapidly reciprocating both drive handles 144 upwardly generally toward the diver's head.

Referring now to FIGS. 9-13, a third embodiment of an oscillating fin propulsion apparatus is generally identified by the reference numeral 300. In many respects the propulsion apparatus 300 is similar to the propulsion apparatus 100 described hereinabove. Common references numerals are therefore used to identify common components.

Figure 12:
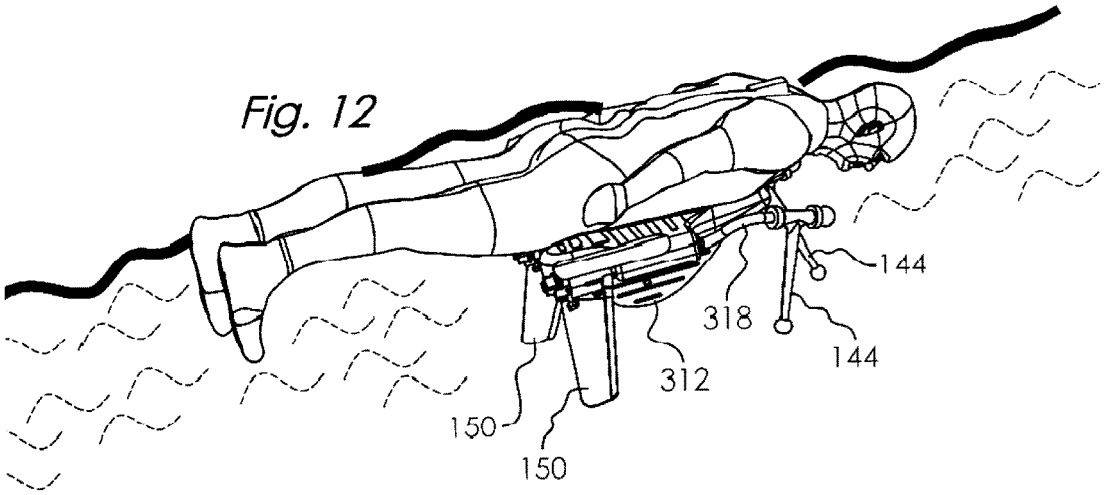
FIG. 12 is a perspective view illustrating a diver in a face down position on a water surface, outfitted with the oscillating fin propulsion apparatus shown in FIG. 9.
Figure 13:
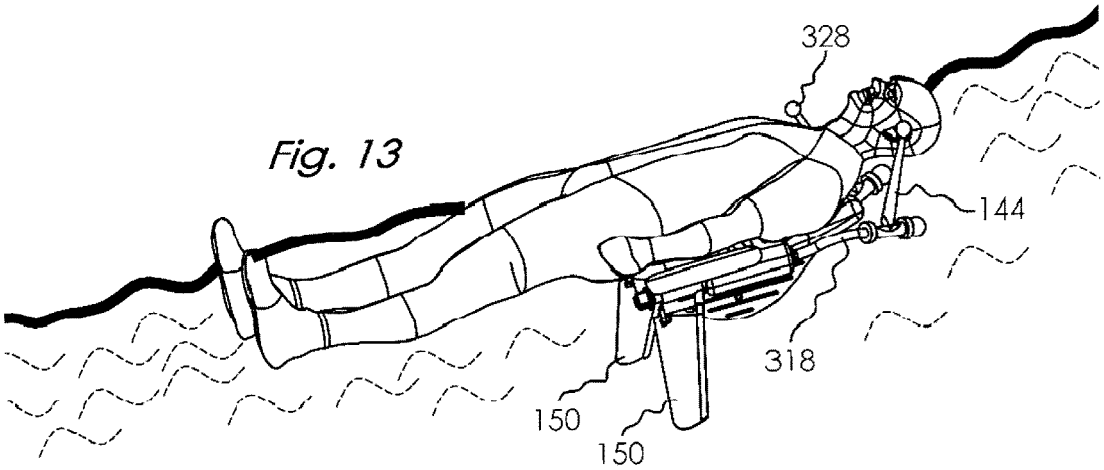
FIG. 13 is a perspective view illustrating a diver in a face up position on a water surface, outfitted with the oscillating fin propulsion apparatus shown in FIG. 9.

The propulsion apparatus 300 may include a floatation device 310 that is sufficiently buoyant to maintain a user floating at or near the surface of a body of water. The floatation device 310 may include a body 312 and a stabilizing blade 314 projecting from the body 312. A user may attach the floatation device 310 to the front or back of his body as shown in FIGS. 12 and 13.

Figure 11:
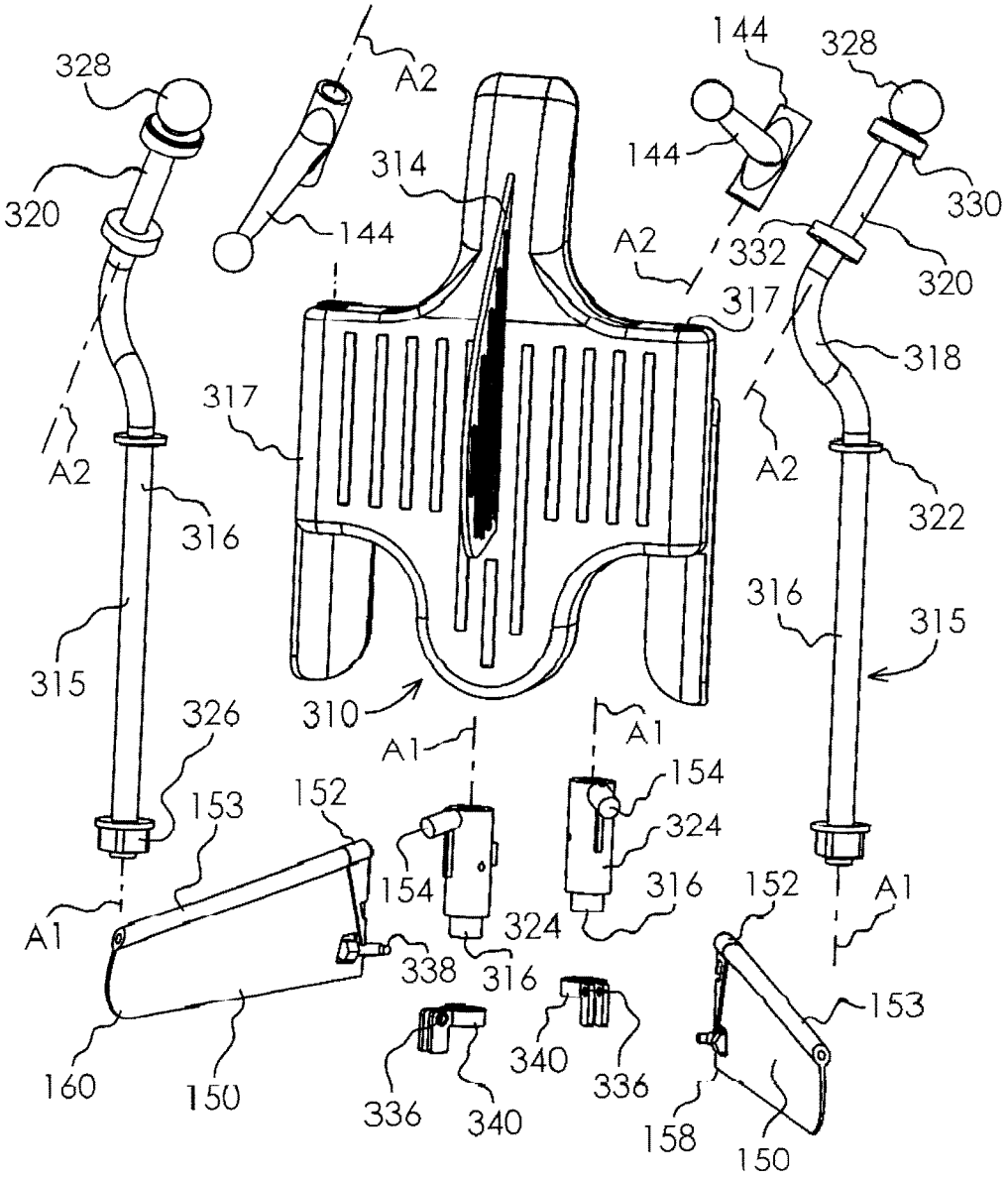
FIG. 11 is an exploded perspective view of the third embodiment of an oscillating fin propulsion apparatus shown in FIG. 9.

Referring now to FIG. 11, longitudinal passageways 317 extend through the body 312 on opposite sides thereof. The passageways 317 are spaced from and extend parallel to the central longitudinal axis of the floatation device 310. Drive tubes 315 may include an elongated lower portion 316 defining an axis A1. The lower portion 316 of the drive tubes 315 may be inserted through the passageways 317. A stop member 322 may be fixedly secured proximate the upper end of the lower portion 316 of the drive tubes 315 for engaging the upper end of the passageways 317 and limiting further advance of the drive tubes 315 through the passageways 317. Lower distal ends of the drive tubes 315 extend out of the lower ends of the passageways 317.

The floatation device 300 may include fins 150 mounted proximate the distal ends of drive tubes 315. A tube 324 may be mounted on the lower distal portion of each of the drive tubes 315. The tubes 324 may be keyed to the drive tubes 315 so that they rotate with the drive tubes 315 about the first axis A1, defined by the elongated lower portion 316 of the drive tubes 315. A retaining nut 326 may be removably secured to the distal end of the drive tubes 315.

The drive tubes 315 may further include a curved intermediate portion 318, and an upper handlebar portion 320. The intermediate portion 318 is disposed between distal ends of the elongated lower portion 316 and the upper handlebar portion 320, fixedly connected therewith to form a unitary drive member. The handlebar portion 320 may define a second axis A2 lying in a common plane passing through the handlebar portion 320 and the elongated lower portion 316 the tubes 315. The axis A2 may be angularly displaced relative to the axis A1. A retaining member 328, such as a ball-shaped connector and the like, may be threadedly connected or otherwise secured to the distal end of the handlebar portion 320. The retaining member 328 may be removed to slide the connector end 142 of the drive handles 144 over the handlebar portion 320. The connector end 142 of the drive handles 144 may be disposed between the retaining member 328 and a stop member 332 fixed proximate the intermediate portion 318 of the drive tubes 315. Axial movement of the connector end 142 of the drive handles 144 may be prevented by the retaining member 328 and stop member 332, but the drive handles 144 may rotate relative to the handlebar portion 320 and the axis A2. The axes A1 and A2 of the drive tubes 315 may be angularly displaced from one another by an angle of about ten (10°) to forty-five (45°) degrees, preferably about thirty (30°) degrees, as described in greater detail hereinabove with reference to propulsion apparatus 100.

The fins 150 and fin masts 152 may be secured to the tubes 324 at the bosses 154 in the manner described above with reference to the propulsion apparatus 100. The squared corner 156 of the fins 150 may be secured to a clew connector 336 by a clevis pin 338 and the like. Clew connector 336 may rotate a limited amount relative to the tubes 324, where for example, but not by limitation, a clew collar 340 may be rotatably mounted proximate the lower distal end of the drive tubes 315 concentric with the tubes 324.

As shown in FIGS. 12 and 13, a user may operate the propulsion apparatus 300 facing down or facing up while moving forward at or near the surface of a body of water. Alternatively, the buoyancy of the floatation device 310 may be adjusted so that the user may operate the propulsion apparatus 300 while submerged.

Figure 14:
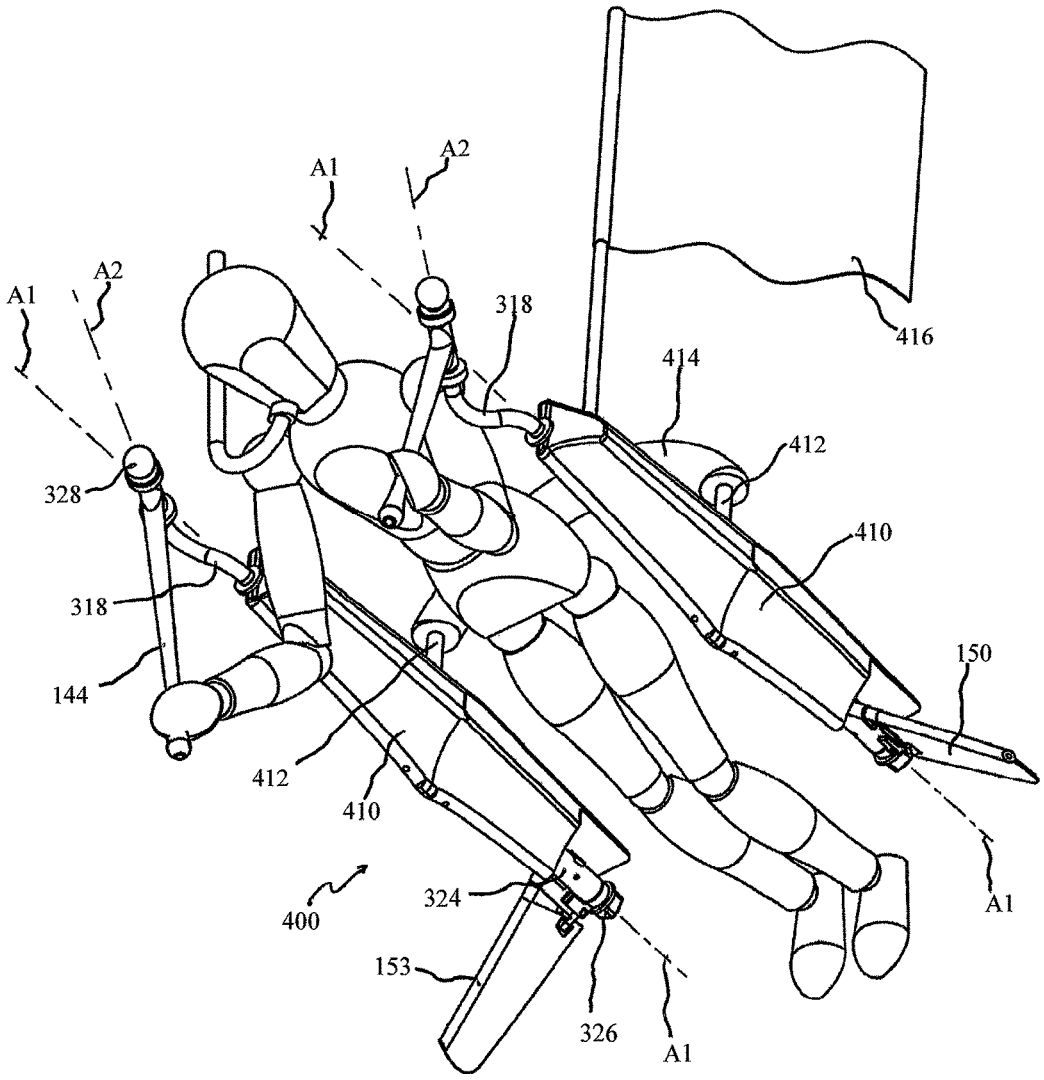
FIG. 14 is a perspective view of a diver outfitted with a fourth embodiment of an oscillating fin propulsion apparatus.

Referring now to FIG. 14, a fourth embodiment of an oscillating fin propulsion apparatus is generally identified by the reference numeral 400. In many respects the propulsion apparatus 400 is similar to the propulsion apparatus 300 described hereinabove. Common references numerals are therefore used to identify common components.

The propulsion apparatus 400 may be operated by the user in a face down manner while snorkeling and the like. Oscillating fins 150 may be driven by drive tubes 315. As with the propulsion apparatus 300, the intermediate portions 318 of the drive tubes 315 interconnect upper and lower portions of the drive tubes 315, which define canted axes A1 and A2. Right and left pontoons 410 may be maintained in a spaced relationship to one another by a rigid bridge member 412. A foam bridge cover 414 may be provided as desired. The drive tubes 315 may extend through passageways in the pontoons 410 in much the same manner as the drive tubes 315 extend through the passageways 317 described above with reference to the propulsion apparatus 300. A flag 416 may project upwardly from the bridge member 412 for safety purposes to minimize potential collisions with watercraft, paddle boards and the like. Reciprocation of the drive handles 144 by the diver transversely oscillates the fins 150 to provide a forward propulsive force.

Figure 15:
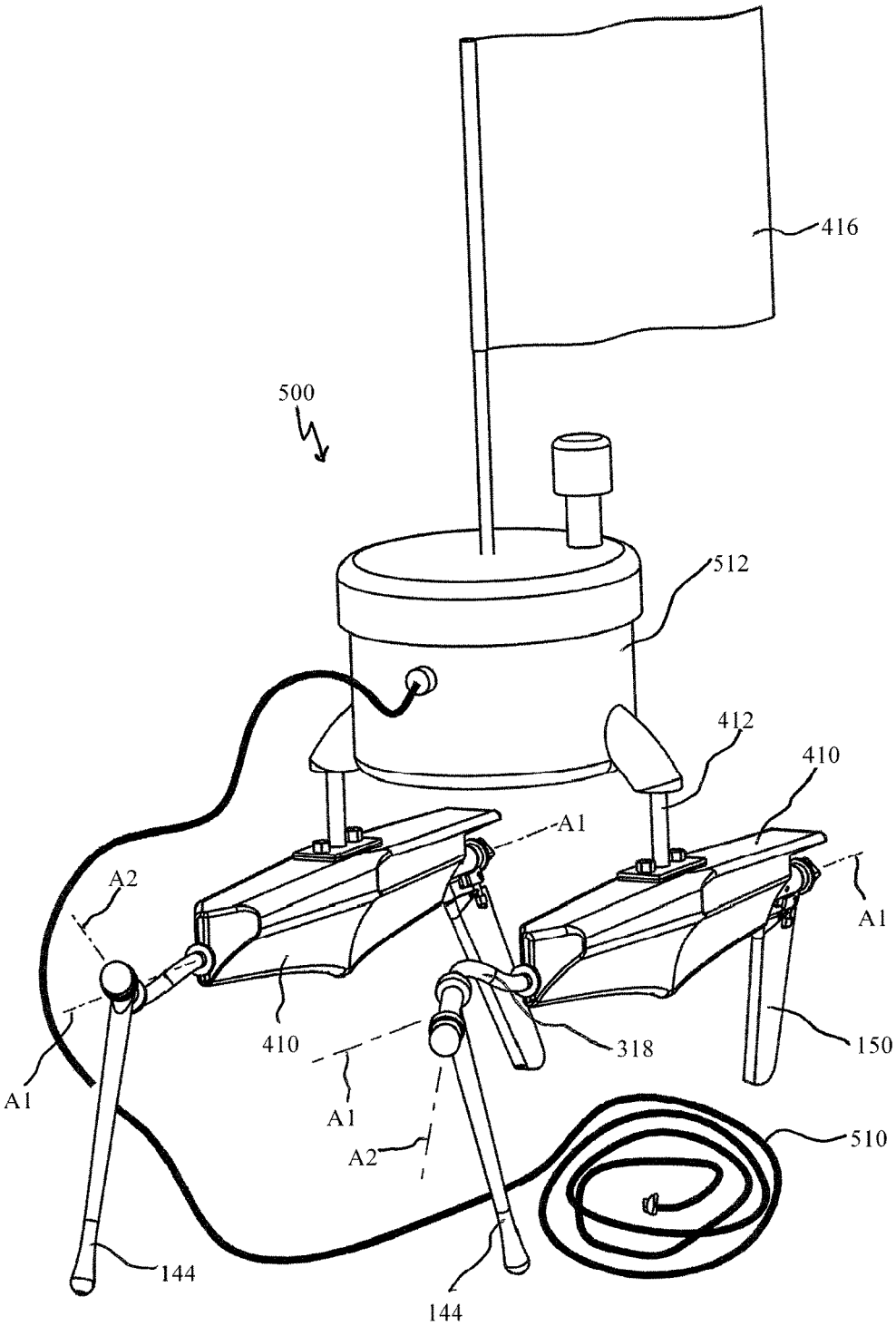
FIG. 15 is a perspective view of a fifth embodiment of an oscillating fin propulsion apparatus.

Referring now to FIG. 15, a fifth embodiment of an oscillating fin propulsion apparatus is generally identified by the reference numeral 500. In many respects the propulsion apparatus 500 is similar to the propulsion apparatus 400 described hereinabove. Common references numerals are therefore used to identify common components.

The propulsion apparatus 500 may generally be described as a hookah diving system supported by a pair of pontoons 410. A hookah diving system is known in the art and typically consists of an electric or gasoline powered oil-less compressor that delivers air to an accumulator. A diver breathes through a low pressure regulator connected by an air line 510 to a surface motor/accumulator 512. A diver may use the propulsion apparatus 500 to dive to greater depths, such as 20 to 90 feet, for example. The propulsion apparatus 500 may be moved to different locations by the diver by manipulating the drive handles 144 in generally vertical longitudinal planes to cause the fins 150 to oscillate laterally in a manner described hereinabove with reference to propulsion apparatus 100.

Figure 16:
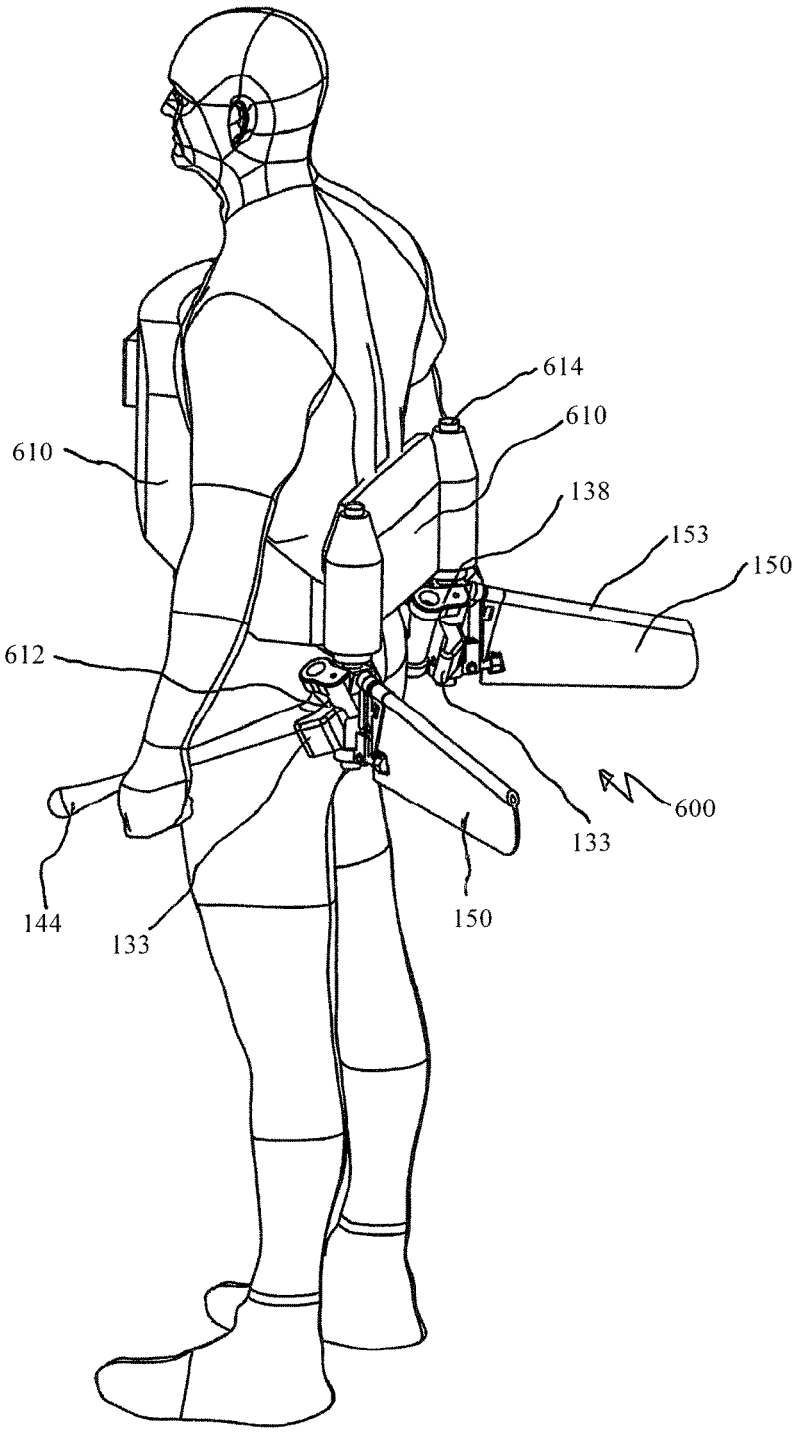
FIG. 16 is a perspective view of a diver outfitted with a sixth embodiment of an oscillating fin propulsion apparatus.
Figure 17:
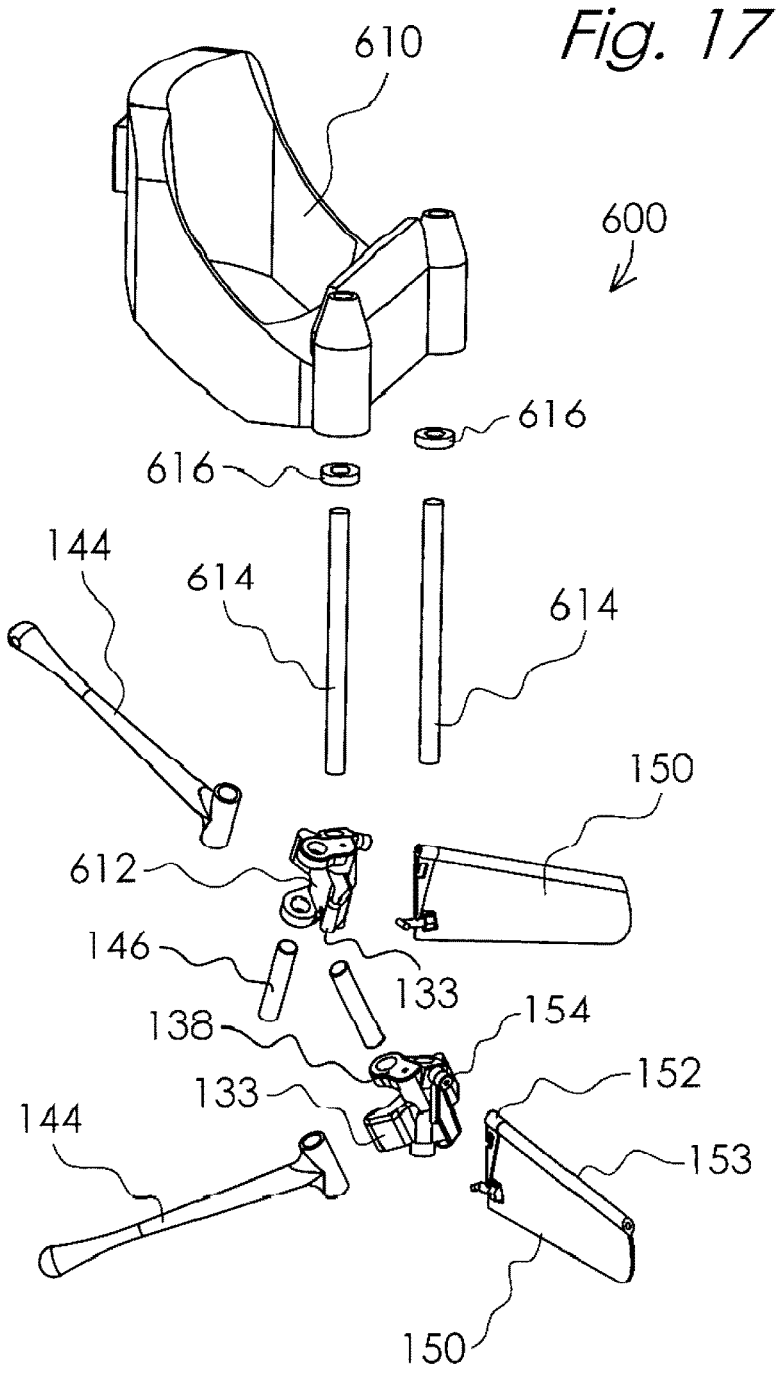
FIG. 17 is an exploded perspective view of the sixth embodiment of an oscillating fin propulsion apparatus.

Referring now to FIGS. 16 and 17, a sixth embodiment of an oscillating fin propulsion apparatus is generally identified by the reference numeral 600. In many respects the propulsion apparatus 600 is similar to the propulsion apparatus 100 described hereinabove. Common references numerals are therefore used to identify common components.

The propulsion apparatus 600 may include a floatation device, such as, but not by limitation, a floatation survival vest 610 including means for propulsion. The greatest volume of the vest 610 is in the front to insure that the diver floats face up. Drive handles 144 are connected to the fins 150 through canted axis blocks 612. The canted axis blocks 612 include a first axis concentric with shafts 614. The shafts 614 are fixedly secured to the vest 610 in spaced apart relationship. Bushings 616 may be mounted on the shafts 614 providing a wear surface between the vest 610 and the canted axis blocks 612. The canted axis blocks 612 further include a second axis that is angularly displaces from the first axis. The drive handles 144 and fins 150 may be secured to the canted axis blocks 612 in a manner described in greater detail hereinabove with reference to the propulsion apparatus 100.

Referring next to FIGS. 18-21, an alternate design for canted journal blocks 130, 132 and fins 150 is shown. Only the canted journal block 130 and one fin 150 are shown in FIGS. 18-21, it being understood that canted journal block 132 and the second fin 150 may be identical.

Figure 18:
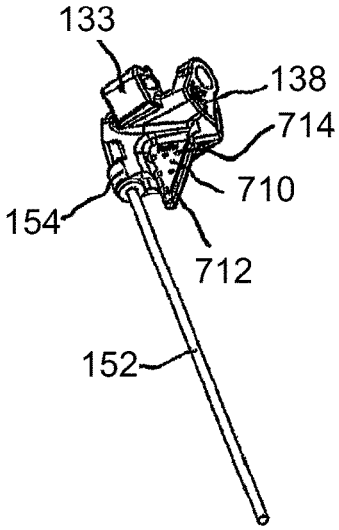
FIG. 18 is a perspective view of an alternate embodiment of the mounting block shown in FIG. 4.

Referring now specifically to FIG. 18, canted journal block 130 may include a pair of downwardly extending plates 710 fixedly secured to the body of the canted journal block 130 proximate the boss 154. Alternatively, the plates 710 may be integrally formed with the canted journal block 130. The plates 710 are spaced apart from one another defining a gap or channel 712 therebetween. Each of the plates 710 may include a plurality of holes 714 axially aligned in pairs for receiving a connector, such a bolt and the like, therethrough. The fin 150 may likewise include a plurality of through holes 716 in the region proximate a cutout 718 of the fin 150, shown in FIG. 21. The fin 150 may include a longitudinal borehole 720 extending proximate the leading edge 153 of the fin 150. The borehole 720 may be configured to receive the fin mast 152. The fin 150 may be secured to the canted journal block 130 by sliding the fin mast 152 into the borehole 720 and positioning a corner portion of the base 155 of the fin 150 between the plates 710 and aligning the holes 716 of the fin 150 with the holes 714 of the plates 710. Fasteners inserted through the aligned holes 714 and 716 fixedly secure the fin 150 to the canted journal block 130.

Directing attention again to FIGS. 18-21, collectively, the fin 150 may include a firm or rigid portion 722 proximate the leading edge 153 extending from the fin base 155 to the distal end 160 thereof, and a flexible portion 724 tapering toward the trailing edge 158. The composition of the fin 150 may range between substantially rigid to substantially flexible materials or a composite material of rigid and flexible portions. For a fin composed of rigid material, the fin 150 may be configured to rotate relative the fin mast 152 permitting the fin 150 to twist and form an angle of attack during oscillation to provide a forward thrust force. For a fin composed of flexible material, the leading end 153 of fin 150 may be fixed to the fin mast 152 without affecting it ability to twist and form an angle of attack during oscillation to provide a forward thrust force.

Figure 19:
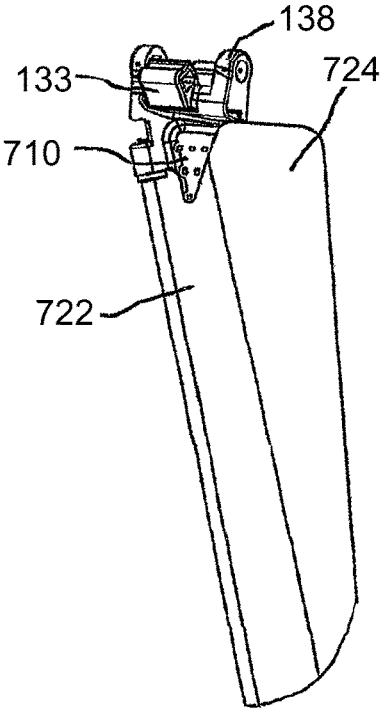
FIG. 19 is a perspective view of an alternate fin design for an oscillating fin propulsion apparatus.
Figure 20:
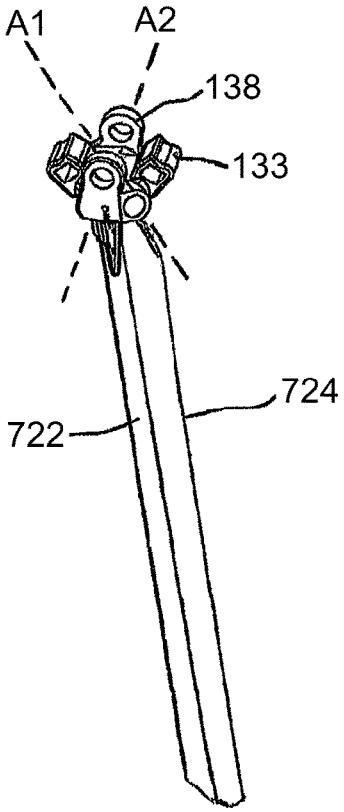
FIG. 20 is another perspective of the fin shown in FIG. 19.
Figure 21:
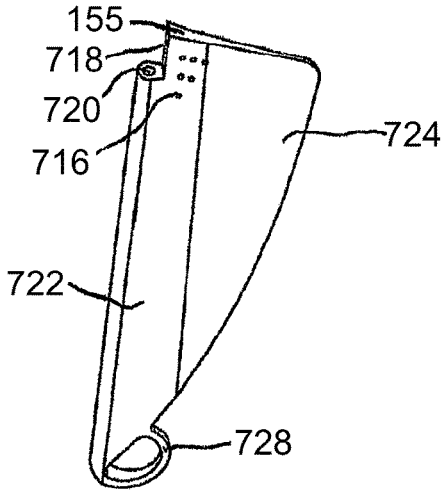
FIG. 21 is a perspective view of the fin shown in FIG. 19 provided with a loop at a distal end thereof.

The fin 150 configurations shown in FIGS. 19-21, for example, but not by limitation, may be formed of composite materials and the fin 150 may rotate relative the fin mast 152.

The fin 150, shown in FIG. 21, may include a loop 728 as a safety measure. For some activities, many divers may be close to each other in the same general area where the fins of one diver may poke or strike another diver in an eye or about the head. The loop 728 may ameliorate the potential harm resulting from such contact.

Figure 22:
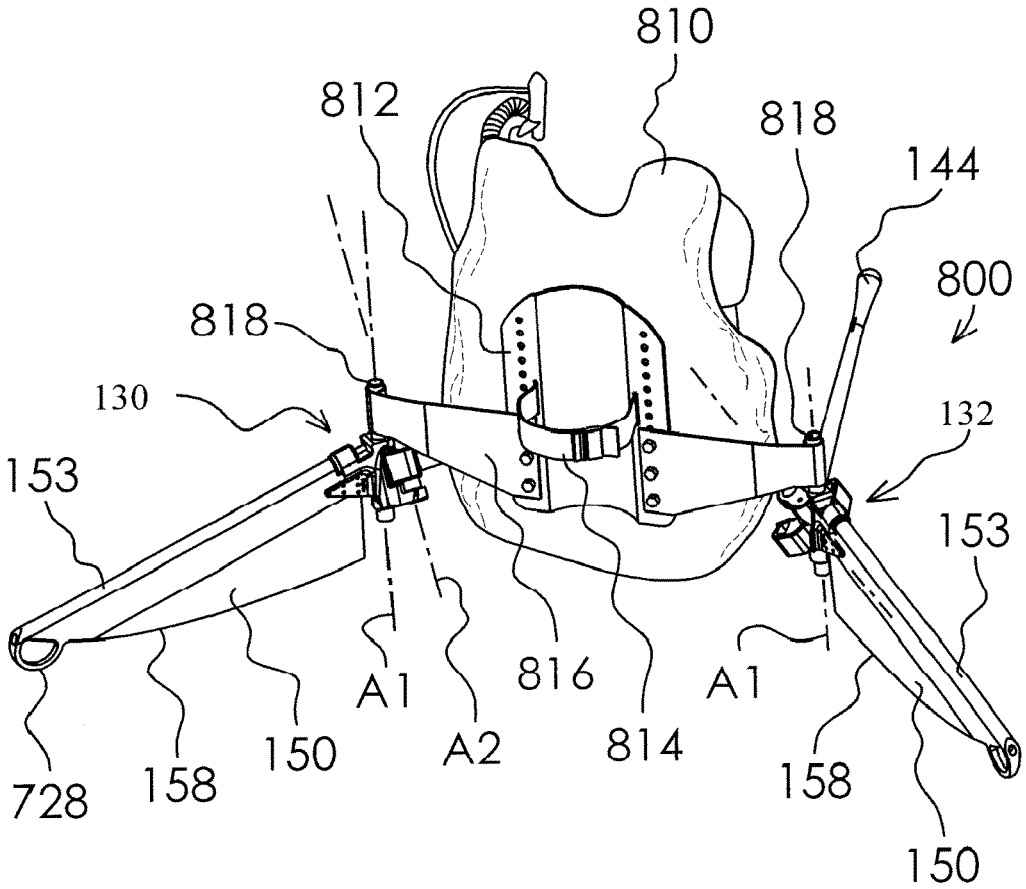
FIG. 22 is a perspective view of a seventh embodiment of an oscillating fin propulsion apparatus.

Referring now to FIG. 22, a seventh embodiment of an oscillating fin propulsion apparatus is generally identified by the reference numeral 800. In many respects the propulsion apparatus 800 is similar to the propulsion apparatus 100 described hereinabove. Common references numerals are therefore used to identify common components.

The propulsion apparatus 800 may include a buoyancy control device (BCD). A BCD is know in the art and may generally include a fabric vest 810 and an air bladder (not illustrated) mounted to a rigid plate 812 of metal or thick nylon and the like. The air bladder may be inflated or deflated by the diver so that he can maintain neutral buoyancy throughout a dive. The plate 812 is typically positioned in the back of the BCD and an air tank (not illustrated) may be secured to the plate 812 by straps 814 and the like. Laterally extending brackets 816 may be fixedly secured to the plate 812. Mounting shafts 818 extending parallel to the longitudinal center axis of the BCD may be mounted at the distal ends of the brackets 816. Canted journal blocks 130, 132 may be rotatably mounted on respective shafts 818. The canted journal blocks 130, 132 include a first axis A1 concentric with the shafts 818. The canted journal blocks 130, 132 may include a second axis A2 that is angularly displaced from the first axis A1. The drive handles 144 and fins 150 may be secured to the canted journal blocks 130, 132, in the manner described in greater detail hereinabove with reference to the several propulsion apparatus embodiments. Alternatively, but not by way of limitation, the brackets 816 may be eliminated and the shafts 818 mounted directly to the plate 812.

While several embodiments of oscillating fin propulsion apparatus have been shown and described herein, other and further embodiments of oscillating fin propulsion apparatus may be devised without departing from the basic scope thereof, and the scope thereof is determined by the claims which follow.

The invention claimed is:

1. A water propulsion apparatus, comprising:
   a) a frame;
   b) left and right canted journal blocks rotatably mounted on respective sides of said frame, each said left and right canted journal blocks including a first longitudinal axis and a second longitudinal axis, wherein a respective said second longitudinal axis is canted relative to a respective said first longitudinal axis;
   c) left and right fins secured to respective said left and right canted journal blocks; and
   d) left and right drive members rotatably connected to respective said left and right canted journal blocks, said left and right drive members rotatable about a respective said second longitudinal axis of each said left and right canted journal blocks.

2. The propulsion apparatus of claim 1 wherein said frame includes an upper frame member separable from a lower frame member.

3. The propulsion apparatus of claim 1 wherein said left and right canted journal blocks include spaced apart upstanding tabs having through holes concentric with a respective said second longitudinal axis.

4. The propulsion apparatus of claim 1 wherein a respective said second longitudinal axis is canted at an angle between 10° to 45° relative to a respective said first longitudinal axis.

5. The propulsion apparatus of claim 1 wherein a respective said second longitudinal axis is canted at an angle of 30° relative to a respective said first longitudinal axis.

6. The propulsion apparatus of claim 1 wherein actuation of said left and right drive members oscillates respective said left and right fins transversely to said first longitudinal axis, and wherein said left and right fins transversely oscillate through an arcuate path of up to 120°.

7. The propulsion apparatus of claim 1 wherein said left and right drive members reciprocate in a generally vertical plane through a range of motion of up to 60°.

8. The propulsion apparatus of claim 1 wherein actuation of said left and right drive members in a reciprocating motion in a generally vertical stroking plane transmits a torque force through respective said left and right canted journal blocks for oscillating respective said left and right fins transversely to said first longitudinal axis of respective said left and right canted journal blocks.

9. The propulsion apparatus of claim 2 including fasteners connecting said upper frame member to said lower frame member for removably securing said frame on an air tank.

* * * * *